United States Patent [19]

Armitage

[11] Patent Number: 4,781,386

[45] Date of Patent: Nov. 1, 1988

[54] FLETCHING ALIGNMENT NUT

[76] Inventor: George E. Armitage, 620 Dedham Dr., Port Richey, Fla. 34668

[21] Appl. No.: 80,018

[22] Filed: Jul. 31, 1987

[51] Int. Cl.[4] ..... F41B 5/02

[52] U.S. Cl. ..... 273/422

[58] Field of Search ..... 273/416, 419–423

[56] References Cited

U.S. PATENT DOCUMENTS

| | | | |
|---|---|---|---|
| 4,006,901 | 2/1977 | Simo | 273/422 |
| 4,210,330 | 7/1980 | Kosbab | 273/422 |
| 4,381,866 | 5/1983 | Simo | 273/422 |
| 4,410,184 | 10/1983 | Anderson | 273/422 |
| 4,565,377 | 1/1986 | Troncoso, Jr. et al. | 273/422 |

OTHER PUBLICATIONS

Archery, 4–1978, p. 14, "Snuggers".

*Primary Examiner*—Paul E. Shapiro

*Attorney, Agent, or Firm*—Dominik, Stein, Saccocio & Reese

[57] ABSTRACT

An arrow which includes a broadhead having a tapered body with axial blade receiving slots formed therein and an axial aperture formed in the rearward end thereof, a point coupled to the forward end of the body, and blades removably received in the slots with their forward ends removably secured in position by the point and with their rearward ends extending rearwardly of the body. The arrow also includes a shaft having a nock at the rearward end therof, an axial aperture formed in the foward end thereof and fletching symmetrically arranged around its periphery adjacent to the nock equal in number to the number of blades. The arrow also includes an assembly coupling the broadhead and shaft. The assembly comprises a cylindrical stem having cylindrical surfaces formed on its forward and rearward ends coupled to the axial apertures in the rearward end of the broadhead and the forward end of the shaft and intermediate external threads therebetween. The assembly also includes a cylindrical cap having internal threads received on the intermediate threads whereby rotation of the cap with respect to the stem will adjust the axial position of the cap along the length of the stem allowing for the varying of the rotational position of the broadhead with respect to the shaft. The assembly yet further includes an adjusting washer positionable for correcting rotational non-symmetry of the arrow.

19 Claims, 2 Drawing Sheets

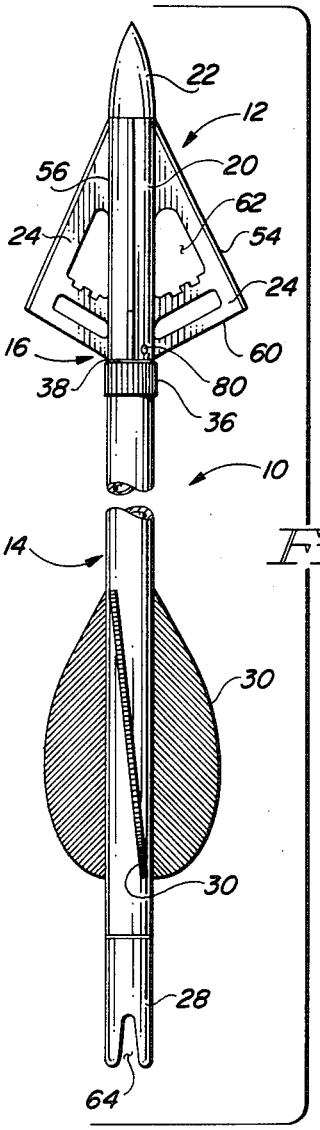
FIG. 1
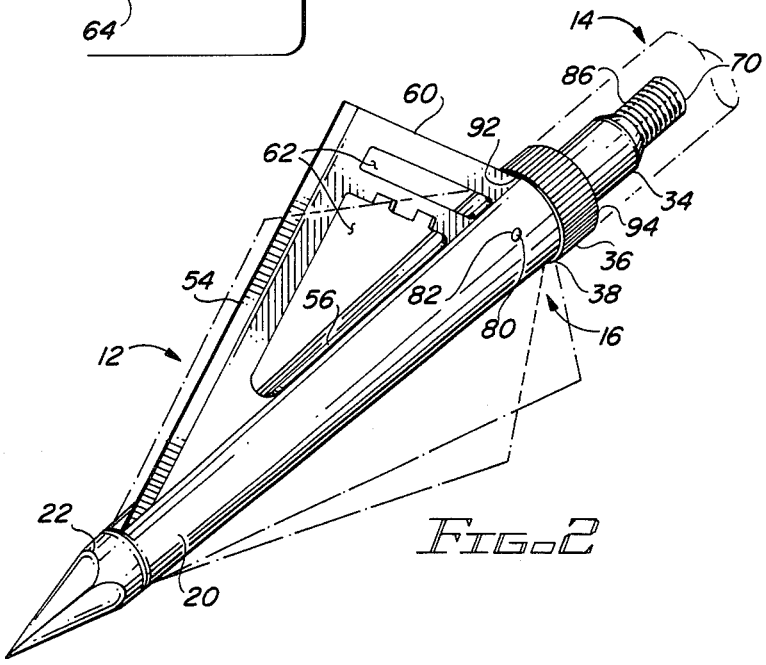
FIG. 2
FIG. 3
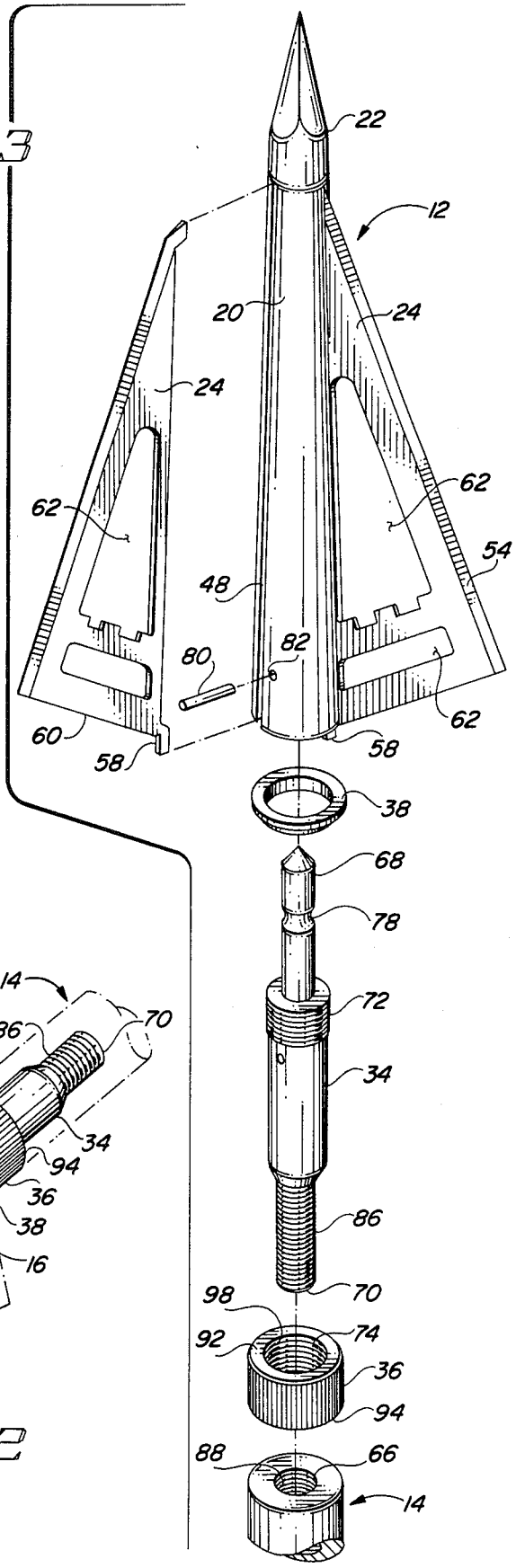

FLETCHING ALIGNMENT NUT

BACKGROUND OF THE INVENTION

1. Summary of the Invention

This invention generally relates to aligning the blades and fletching of an arrow and, more particularly, to an arrow provided with an improved coupling assembly between its shaft with fletching and its broadhead with blades to adjust the rotational orientation therebetween so as to axially align the broadhead and fletching for optimizing the aerodynamic characteristics of the arrow.

2. Summary of the Background Art

The flight of an arrow may be adversely affected by a wide variety of factors, internal and external. Adverse external factors include environmental conditions, particularly the wind. Adverse internal factors include excessive drag during flight, rotational non-symmetry and the like. These internal factors may be aggravated with the use of hunting arrows employing broadheads.

A broadhead is that portion of a hunting arrow located at the forward or tip end. It includes individual blades, normally interchangable, and an arrangement for its removable coupling with the shaft. Broadheads are removably coupled to the forward end of a shaft in order to provide the user with the ability to select an appropriate broadhead matched with the intended game. Such removability also allows the user to uncouple a shaft from a broadhead which has become irretrievably imbedded in a tree or other surface and to provide the forward end of such shaft with a new broadhead. Blade interchangability allows the user to replace a damaged blade or blades of a broadhead. The interchanging of blades normally involves the uncoupling of broadhead and shaft. The uncoupling and recoupling of broadhead and shaft is, therefore, not uncommon.

The coupling and uncoupling of a broadhead and shaft always carries with it the possibility of introducing misalignment into the arrow between the blades and fletching. Any misalignment within an arrow will cause its flight to be aerodynamically deficient because of drag or rotational wabble. Proper alignment within an arrow will improve its internal factors and also make it less affected by external factors such as the wind.

One prior technique for rotationally adjusting broadheads and shafts was in common usage when they were coupled by an adhesive. According to that technique, the rearward end of the broadhead included a male coupling cylinder which was received within a mating female cylindrical opening at the forward end of the shaft. Included therebetween was an adhesive, softenable under heat, which could allow for the desired rotational alignment. Such a technique, however, was time consuming and somewhat inconvenient since it required heat which was not always available, particularly since a user might wish to change broadheads in the field. Additionally, shafts and broadheads are now more often coupled with newer, stronger adhesives which are epoxy based. Such newer adhesives are not softenable upon the application of heat so that this rotational adjustment technique is no longer available.

Arrows should thus be designed for the uncoupling and recoupling of broadhead and shaft in such a way as to allow for the convenient rotational adjustment between broadhead and shaft to thereby axially align the blades of the broadhead with the fletching of the shaft.

The patent literature shows that this design objective is well recognized. It does not, however, provide any solution which is sufficiently efficient, convenient, reliable and economical. Consider, for example, U.S. Pat. No. 4,210,330 to Kosbab. According to that disclosure, a resilient washer of rubber, plastic or the like is positioned between the broadhead and shaft. Tightening or loosening of such rotational elements may thus bring the rotational elements into proper alignment through the compressing or relaxing of the washer. Unfortunately, the elastic limit of the washer will limit the degree of rotational adjustment available which may or may not provide sufficient adjustment capabilities for a particular application. Further, the elastic limit of the washer will vary through age and use. Beyond this, the tightening will induce a bulge in the washer and detract from the aerodynamic properties of the arrow.

U.S. Pat. No. 4,036,499 discloses an improved arrangement for releasably coupling a broadhead and shaft. This arrangement includes a one piece cylindrical member threaded at both ends for releasably coupling a broadhead and shaft. An intermediate collet formed integrally with the cylindrical member limits the axial movement of the broadhead and shaft with respect to the cylindrical member. This constitutes a convenient arrangement for releasably coupling the parts of an arrow but provides for no adjustment capabilities normally desired by users of arrows.

As illustrated by the large number of prior patents as well as commercial devices, efforts are continuously being made in an attempt to adjustably couple arrow broadheads and shafts more efficiently, conveniently, reliably and economically. None of these previous efforts, however, provide the benefits attendant with the present invention. Additionally, prior techniques and apparatus do not suggest the present inventive combination of component elements arranged and configured as disclosed and claimed herein. The present invention achieves its intended purposes, objectives and advantages over the prior art devices through a new, useful and unobvious combination of component elements which is simple to use, with the utilization of a minimum number of functioning parts, at a negligible cost to manufacture and by employing only readily available materials.

Therefore, it is an object of this invention to provide an improved arrow having a shaft with fletching, a broadhead with blades and a coupling assembly therebetween to adjust the rotational orientation between the shaft and broadhead so as to axially align the fletching and blades for optimizing the aerodynamic characteristics of the arrow.

It is a further object of this invention to provide an improved coupling assembly between a shaft with fletching and a broadhead with blades for adjusting the rotational orientation between the shaft and broadhead so as to axially align the fletching and blades.

It is an additional object of the invention to adjust the rotational orientation between the broadhead and the shaft of an arrow.

Lastly, it is an object of the invention to axially align the blades and fletching of an arrow.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with specific embodiments shown in the attached drawings. For the purpose of summarizing the invention, the invention comprises apparatus for coupling an arrow broadhead having blades symmetrically arranged around its periphery and an arrow shaft having fletching symmetrically secured around its periphery in number equal to the number of blades. The apparatus includes a cylindrical stem having first means formed at its forward end for coupling with the rearward end of a broadhead and having second means formed at its rearward end for coupling with the forward end of a shaft and having threads therebetween formed on the exterior surface of the stem. The apparatus also includes a cylindrical cap having internal threads received on the threads of the stem whereby rotation of the cap with respect to the stem will allow for the adjustment of the rotational position of a broadhead with respect to a shaft when coupled to the stem. The apparatus further includes an adjustment washer having an internal aperture of a diameter for positioning over the stem adjacent to one end of the cap. The adjustment washer has an internal diameter sufficiently greater than that portion of the stem upon which it is received to allow for its radial shifting to thereby correct for rotational nonsymmetry. The external diameter of the adjustment washer is less than the external diameter of the cap.

In one embodiment, one of the means includes a circumferential groove to receive a pin for restricting axial movement therebetween. The groove is the first means. In another embodiment, the first and second means are threads of a different number of threads per inch so that the axial position of the cap with respect to the stem will determine the rotational orientation of a broadhead with respect to a shaft to allow for the axial alignment of their blades with their fletching. The cap has a forward abutment surface to limit the movement of a broadhead onto the stem and a rearward abutment surface to limit the movement of a shaft onto the stem.

For the purpose of further summarizing the invention, the invention comprises an arrow which includes a broadhead having a tapered body with a plurality of axial blade receiving slots symmetrically formed around the periphery thereof and an axial aperture formed in the rearward end thereof, a point coupled to the forward end of the body, and blades removably received in the slots with their forward ends removably secured in position by the point and with their rearward ends extending rearwardly of the body. The arrow also includes a shaft having a nock at the rearward end thereof, an axial aperture formed in the forward end thereof and fletching symmetrically secured around its periphery adjacent to the nock equal in number to the number of blades. The arrow also includes an assembly coupling the broadhead and shaft. The assembly comprises a cylindrical stem having a cylindrical forward end coupled within the rearward end of the broadhead and having a cylindrical rearward end coupled within the forward end of the shaft and having intermediate external threads formed therebetween. The assembly also includes a cylindrical cap having internal threads received on the intermediate threads of the stem whereby rotation of the cap with respect to the stem will move the cap along the length of the stem allowing for the varying of the rotational position of the broadhead and shaft with respect to each other. The cap has a forward abutment surface for assisting in the retaining of the blades in their operative positions in the slots. The arrow further includes an adjustment washer received over the stem and the rearward ends of the blades between the forward abutment surface of the cap and the rearward end of the body. The adjustment washer has an internal diameter sufficiently greater than the ends of the blades over which it is received to allow for its radial shifting to thereby correct for rotational nonsymmetry. The external diameter of the adjustment washer is less than the external diameter of the cap. The cap is undercut at its forward end for receiving the rearward ends of the blades to preclude their radial movement out of the slot. The forward abutment surface of the cap provides an axial force with respect to the rearward ends of the blades to preclude their axial movement with respect to the slot.

In one embodiment, one of the ends of the stem includes threads and its associated axial aperture also includes threads received by the threads of the stem while the other of the ends of the stem includes a circumferential groove and its associated axial aperture includes a pin received within the groove to restrict axial movement therebetween. The groove and pin couple the shaft and the broadhead. In another embodiment, the axial apertures and the ends of the stem are all threaded. The threads coupling the stem and broadhead are of a different pitch than the threads coupling the stem and shaft whereby the position of the cap with respect to the stem will determine the rotational orientation of the broadhead with respect to the shaft to allow for the axial alignment of their blades with their fletching.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is an elevational view of an assembled arrow constructed in accordance with the principles of the present invention;

FIG. 2 is an enlarged isometric view of a broadhead and coupling assembly of the arrow constructed in accordance with the first or primary embodiment of the present invention;

FIG. 3 is an enlarged exploded isometric view of the broadhead, the forward end of a shaft and coupling assembly of the arrow as shown in FIGS. 1 and 2;

Similar reference characters refer to similar parts throughout the several views of the drawings.

DETAILED DESCRIPTION OF THE INVENTION

Figure 7:
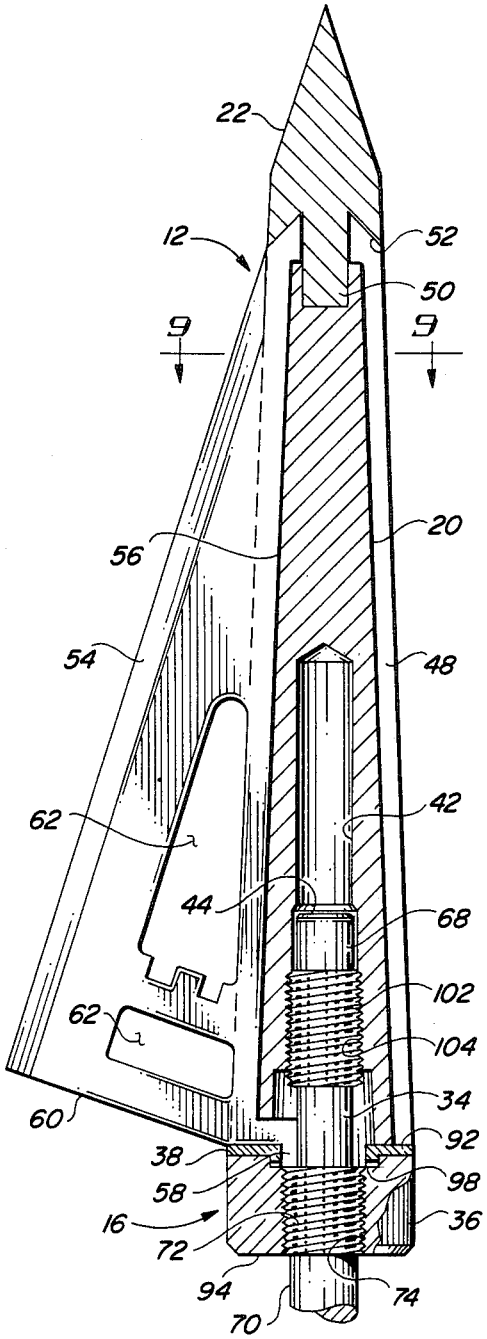
FIG. 7 is an enlarged elevational view, partially in section, of a broadhead and coupling assembly of an arrow constructed in accordance with a second or alternate embodiment of the present invention.
Figure 4:
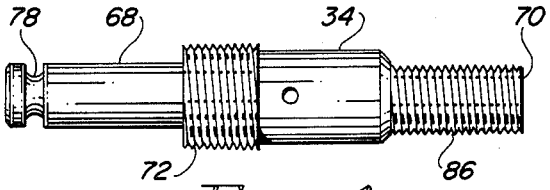
FIG. 4 is a side elevational view of the stem constructed in accordance with the first or primary embodiment.
Figure 5:
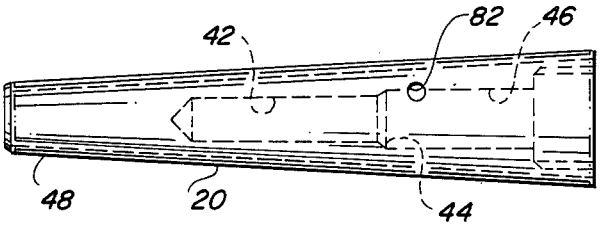
FIG. 5 is a side elevational view of the body constructed in accordance with the first or primary embodiment.
Figure 6:
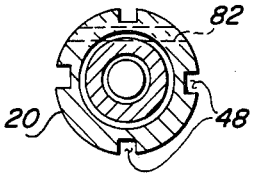
FIG. 6 is an end elevational view of the body as shown in FIG. 5.

Shown in FIG. 1 is the improved arrow 10 which includes a broadhead 12 and a shaft 14 adjustably joined by the coupling assembly 16 constructed in accordance with the principles of the present invention. The broadhead 12 includes a tapered body 20, a point 22 at its forward end, and a plurality of blades 24 symmetrically spaced around the periphery of the body. The shaft 14 includes a nock 28 at its rearward end and fletching 30 symmetrically secured around the periphery of the shaft and extending radially therefrom adjacent to the nock 28. Centrally located between the broadhead 12 and nock 28 is the assembly 16 for releasably coupling the broadhead 12 and shaft 14. The assembly includes a stem 34 and a cap 36 threadedly received at a central portion of the stem allowing for the adjustment of the rotational orientation between the broadhead and the shaft and, therefore, the blades and fletching. Also located on the coupling assembly 16 is a spin adjustment washer 38 whose position may be varied for insuring rotational symmetry of the arrow.

As used herein, the terms forward, forwardly and the like relate to that end of the arrow 10, or toward that end of the arrow, which includes the point 22. The terms rearward, rearwardly and the like relate to that end of the arrow 10, or toward that end of the arrow, which includes the nock 28.

As can be clearly seen in FIGS. 2 and 3 which show the first or primary embodiment of the invention, the broadhead 12 has for its central component the body 20, formed in a frusto-conical shape. Its rearward end has a diameter enlarged with respect to the forward end. Extending along the central axis of the body is a bore 42 of varying diameters for maximizing strength while reducing weight. Adjacent to its rearward end, the bore is provided with an internal, cylindrical, axial aperture 46 terminating in a bottoming ledge 44. The external diameter of the body 20 at the rearward end is substantially the same as the external diameter of the cap 36. The external diameter of the body at its forward end is of a diameter substantially equal to the external diameter of the rearward end of the point. The body is preferably formed of a one-piece construction as of any suitable plastic, metal or the like. Formed into the external surface, extending between its forward and its rearward ends, are radially extending axial slots 48 of a depth and width to removably receive an equal number of blades, four as shown in the preferred embodiments. Any other number of blades might be utilized as a function of the particular game to be hunted.

Positioned at the forward end of the body 20 is the point 22, a one-piece member molded or otherwise shaped of a rigid material such as a high-polymer plastic with superior strength to weight properties. The point 22 includes a cylindrical member 50 at its rearward end inserted into the bore 42 at the forward end of the body 20. Permanent coupling may be effected by swagging or through the use of an adhesive or the like. The forward end of the point is of a conical configuration for improved flight and target penetrating capabilities. Additionally, the point includes an undercut region 52 where it abuts the forward end of the body 20. The undercut region 52 of the point 22 overlies the forward end of the slots 48 for receiving and holding the forward ends of the blades 24 when positioned for operation and use.

The final components of the broadhead 12 are the radially extending blades 24, formed in a modified V-shaped configuration with sharp cutting edges 54 positioned to constitute smooth continuations of the external surface of the point 22. An elongated linear base edge 56 on each blade is of such length and thickness whereby its forward end will be located beneath the undercut region 52 of the point 22. The rearward end of each blade 24 includes a rearward generally rectangular retention portion 58 which extends axially rearwardly of the rearward end of the body 20 and radially interior of the external surface of the body 20. The blades have an angled rearward edge 60 and particularly configured cutouts 62, all for minimizing weight and maximizing the aerodynamic characteristics of the blades 24, broadhead 12 and arrow 10. The blades are preferably fabricated of a high carbon steel for maximum strength and for holding the sharp, razor-like edge required for repeated use in hunting game.

The shaft 14 may be formed of metal, plastic or the like in a tubular configuration as is conventional in the art of archery and includes a permanently attached nock 28 at its rearward end. The nock is provided with a diametric slot 64 for receiving the string of a bow for propelling the arrow into flight, all in the conventional manner. Permanently secured to the shaft 14, a predetermined distance forward of the nock 28, are a plurality of fletching 30, formed of plastic, feathers or the like to impart stability to the arrow when in flight. As shown in FIG. 1, the preferred embodiment of the invention, the fletching is not purely axial with respect to the shaft and arrow but is provided with a slight angle of inclination with respect to the axis for imparting a rotational motion to the arrow during flight to thereby provide improved aerodynamic characteristics as is well known in the art. Any number of fletching may be employed but it is preferred to use a number equal to the number of blades on the broadhead, four in the preferred embodiment. When such equal numbers are employed, with the blades and fletching axially aligned, reduced drag occurs during the flight of the arrow with improved aerodynamic characteristics imparted to the arrow. Although the arrow is disclosed herein with fletching inclined with respect to the axis of the shaft, it should be appreciated that axially aligned, non-inclined, fletching could readily be employed in practicing the present invention. In addition, the forward end of the shaft 14 is provided with an internal, cylindrical, axial aperture 66 for coupling with the broadhead 12 through the coupling assembly 16.

The third and last portion of the arrow is the coupling assembly 16. This assembly includes a one piece cylindrical stem 34 having a first cylindrical end 68 formed at its forward end for coupling with the aperture 46 at the rearward end of the broadhead 12. The stem 34 has a second external cylindrical end 70 formed at its rearward end for coupling with the aperture 66 at the forward end of the shaft 14. An intermediate set of threads 72, having a larger diameter than the cylindrical ends 68 and 70, is formed therebetween on the exterior surface of the stem. The assembly also includes a cylindrical cap 36 having internal threads 74 matingly received upon the threads 72 whereby rotation of the cap 36 with respect to the stem 34 will allow for the adjustment of the axial position of the cap along the length of the stem. This arrangement is for varying the rotational position of a broadhead 12 with respect to a shaft 14 when coupled to the stem 34.

More specifically, the forward end of the stem is provided with a circumferentially formed groove 78 located a predetermined distance from the forward end of the stem 34. The groove receives the central portion of a pin 80 having a diameter essentially the same as that of the groove. The pin is fixedly positioned in the body 20 by being press fit into holes 82. Axial positioning of the stem into the aperture at the rearward end of the body is effected by the forward end of the stem contacting the ledge 44 whereby the pin 80 may be inserted into its holes 82 independent of the rotational position of the stem with respect to the body and broadhead. External threads 86 on the rearward end of the stem couple with internal threads 88 on the forward end of the shaft releasably coupling the shaft and stem.

The cap has a forward abutment surface 92 to limit its axial movement with respect to the broadhead. The cap also has a rearward abutment surface 94 to limit the axial movement of the shaft with respect to the stem and, therefore, to the broadhead. Consequently, when the cap is threaded against the broadhead it will act as a locknut to draw the groove 78 rearwardly against the pin 80 to preclude movement therebetween. Then the rotation of the shaft onto the stem against the cap will fix its position with respect to the stem and broadhead.

If the rotational alignment of the broadhead with its blades is not correct with respect to the shaft with its fletching, then the shaft is counterrotated with respect to the stem. This allows the cap to be counterrotated with respect to the broadhead loosening the pin with respect to the groove. The broadhead with its pin and blades may then be appropriately rotated with respect to the groove and stem to effect the desired proper rotational positioning therebetween. The cap is then tightened against the broadhead to secure their positioning whereafter the shaft is tightened against the cap for completion of the positioning and securement of the parts with respect to each other.

The assembly may further include an adjustment washer 38 having an internal aperture of a diameter so that it may be positioned over the stem 34 and over the rearwardly extending generally rectangular retention portions 58 of the blades adjacent to the forward abutment surface 92 of the cap. The external diameter of the adjustment washer 38 is less than the external diameter of the cap so as not to create a drag-inducing projection extending radially beyond the exterior surface of the arrow. The internal diameter of the washer is sufficiently great to allow for its radial shifting to thereby correct for rotational non-symmetry. Holding the arrow vertically on a horizontal surface and spinning it on its axis will indicate rotational non-symmetry in the arrow by any wobble noted during its spinning. The repositioning of the washer radially will thereby redistribute the weight of the arrow about its axis to overcome any imbalance of weight for thereby restoring the arrow to its desired rotational symmetry.

As can be seen in FIGS. 3 and 7, the cap has an undercut area 98 at its forward end for receiving the rearward extending retention portions 58 of the blades to thereby preclude their radial movement out of the slots 48. In association therewith, the forward abutment surface 92 of the cap 36 provides an axial force, acting through the adjustment washer 38, with respect to the rearward edge 60 of the blades to preclude their axial movement with respect to the slot. As such, the stem, adjustment washer, cap, body and point all function for removably retaining the blades in their desired affixed locations.

Figure 8:
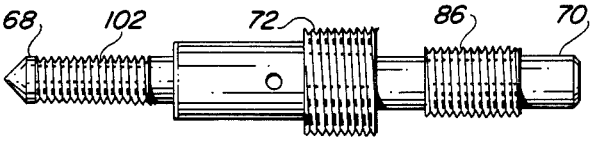
FIG. 8 is a side elevational view of a stem constructed in accordance with the second or alternate embodiment of the present invention.
Figure 9:
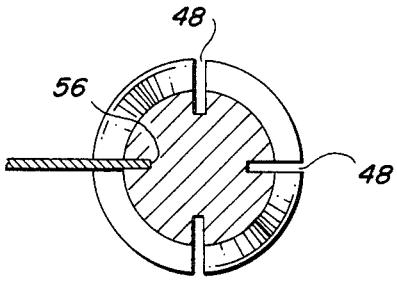
FIG. 9 is a sectional view of a body and blade taken along line 9—9 of FIG. 7.

In the second or alternate embodiment of the invention shown in FIGS. 7, 8 and 9, the forward end of the stem is provided with external threads 102 while the rearward end of the body 20 is provided with internal threads 104. These threads are used to couple the broadhead and stem rather than the groove 78, pin 80 and holes 82 of the first or primary embodiment. The threads coupling the stem and body are of a different pitch, or threads per linear inch, than the threads coupling the stem and shaft.

By way of example, the threads coupling the stem and body are 8–32 while the threads coupling the stem and shaft are 12–28. The 8 and 12 designations refer to the diameter of the threads. The 32 and 28 designations refer to pitch or the number of threads per linear inch. The difference in pitch is required in order that rotation between the shaft, stem and broadhead may vary the angular orientation between the shaft and the broadhead.

If the threads coupling the various components were of the same pitch, 30 for the sake of illustration, one 360 degree rotation of the cap and shaft with respect to the stem and broadhead would create a gap of 1/30th of an inch between the cap and broadhead, on one side or the other of the adjustment washer 38. A rotation of the broadhead with respect to the stem and cap sufficient to close the gap would merely return the shaft and broadhead to their original rotational orientation with respect to each other.

When, however, the threads at the ends of the stem are of a different pitch, as described above, a 360 degree rotation of the shaft and cap with respect to the stem and broadhead would create a gap of 1/32nd of an inch between the cap and broadhead. Rotating the broadhead with respect to the stem and cap sufficient to close the gap would cause a rotation proportionately greater than 360 degrees as defined by the ratio of the pitches employed. In this manner, the rotational orientation of fletching and blades can readily be modified. Such modification can be determined mathematically but, as a practical matter, adjustments by a user will normally be done by trial and error, improving with experience.

The present disclosure includes that contained in the appended claims as well as that of the foregoing description. Although this invention has been described in its preferred form with a certain degree of particularity, it is understood that the present disclosure of the preferred forms has been made only by way of example and that numerous changes in the details of construction and combination and arrangement of parts may be resorted to without departing from the spirit of the invention. Now that the invention has been described,

What is claimed is:

1. For use in association with an arrow broadhead having a blades symmetrically arranged around its periphery and an arrow shaft having fletching symmetrically secured around its periphery in number equal to the number of blades, apparatus for coupling a broadhead and a shaft comprising:

a cylindrical stem having first means formed at its forward end for coupling with the rearward end of a broadhead and having second means formed at its rearward end for coupling with the forward end of a shaft and having threads therebetween formed on the exterior surface of the stem; and a cylindrical cap having internal threads received on the threads of the stem whereby rotation of the cap with respect to the stem will allow for the adjustment of the rotational position of a broadhead with respect to a shaft when coupled to the stem.

2. The apparatus as set forth in claim 1 and further including an adjustment washer having an internal aperture of a diameter for positioning over the stem adjacent to one end of the cap.

3. The apparatus as set forth in claim 2 wherein the adjustment washer has an internal diameter sufficiently greater than that portion of the stem upon which it is received to allow for its radial shifting to thereby correct for rotational non-symmetry.

4. The apparatus as set forth in claim 3 wherein the external diameter of the adjustment washer is less than the external diameter of the cap.

5. The apparatus as set forth in claim 2 wherein the cap has a forward abutment surface to limit the movement of a broadhead onto the stem and a rearward abutment surface to limit the movement of a shaft onto the stem.

6. The apparatus as set forth in claim 1 wherein one of the means includes a circumferential groove to receive a pin for restricting axial movement therebetween.

7. The apparatus as set forth in claim 6 wherein the groove is the first means.

8. The apparatus as set forth in claim 1 wherein the first and second means are threads of a different number of threads per inch so that the axial position of the cap with respect to the stem will determine the rotational orientation of a broadhead with respect to a shaft to allow for the axial alignment of their blades with their fletching.

9. An arrow including, in combination:

a broadhead having a tapered body with a plurality of axial blade receiving slots symmetrically formed around the periphery thereof and an axial aperture formed in the rearward end thereof, a point coupled to the forward end of the body, and blades removably received in the slots with their forward ends removably secured in position by the point and with their rearward ends extending rearwardly of the body;

a shaft having a nock at the rearward end thereof, an axial aperture formed in the forward end thereof and fletching symmetrically secured around its periphery adjacent to the nock equal in number to the number of blades; and an assembly coupling the broadhead and shaft comprising a cylindrical stem having a cylindrical forward end coupled within the rearward end of the broadhead and having a cylindrical rearward end coupled within the forward end of the shaft and having intermediate external threads formed therebetween, the assembly also including a cylindrical cap having internal threads received on the intermediate threads of the stem whereby rotation of the cap with respect to the stem will move the cap along the length of the stem allowing for the varying the rotational position of the broadhead and shaft with respect to each other.

10. The arrow as set forth in claim 9 wherein the cap has a forward abutment surface for assisting in the retaining of the blades in their operative positions in the slots.

11. The arrow as set forth in claim 10 and further including an adjustment washer received over the stem and the rearward ends of the blades between the forward abutment surface of the cap and the rearward end of the body.

12. The arrow as set forth in claim 11 wherein the adjustment washer has an internal diameter sufficiently greater than the ends of the blades over which it is received to allow for its radial shifting to thereby correct for rotational non-symmetry.

13. The arrow as set forth in claim 12 wherein the external diameter of the adjustment washer is less than the external diameter of the cap.

14. The arrow as set forth in claim 11 wherein the cap is undercut at its forward end for receiving the rearward ends of the blades to preclude their radial movement out of the slot.

15. The arrow as set forth in claim 14 wherein the forward abutment surface of the cap provides an axial force with respect to the rearward ends of the blades to preclude their axial movement with respect to the slot.

16. The arrow as set forth in claim 9 wherein one of the ends of the stem includes threads and its associated axial aperture also includes threads received by the threads of the stem while the other of the ends of the stem includes a circumferential groove and its associated axial aperture includes a pin received within the groove to restrict axial movement therebetween.

17. The arrow as set forth in claim 16 wherein the groove and pin couple the shaft and the broadhead.

18. The arrow as set forth in claim 9 wherein the axial apertures and the ends of the stem are all threaded.

19. The arrow as set forth in claim 18 wherein the threads coupling the stem and broadhead are of a different pitch than the threads coupling the stem and shaft whereby the position of the cap with respect to the stem will determine the rotational orientation of the broadhead with respect to the shaft to allow for the axial alignment of their blades with their fletching.

* * * * *